US005174506A

United States Patent [19]

Scheidler

[11] Patent Number: 5,174,506

[45] Date of Patent: Dec. 29, 1992

[54] SHOWER HEAD WITH INTERIOR PLASTIC SLEEVE

[75] Inventor: Jerome D. Scheidler, Elyria, Ohio

[73] Assignee: Moen Incorporated, Elyria, Ohio

[21] Appl. No.: 755,805

[22] Filed: Sep. 6, 1991

[51] Int. Cl.[5] ..... B05B 1/18

[52] U.S. Cl. ..... 239/460; 239/591; 239/DIG. 19

[58] Field of Search ..... 239/460, 591, DIG. 19, 239/587.4

[56] References Cited

U.S. PATENT DOCUMENTS

| | | | |
|---|---|---|---|
| 2,923,482 | 2/1960 | Bucknell | 239/587.4 X |
| 3,189,284 | 6/1965 | Downey | 239/587.4 X |
| 3,547,353 | 12/1970 | Pecka | 239/460 |
| 3,997,116 | 12/1976 | Moen | 239/460 |
| 4,275,843 | 6/1981 | Moen . | |
| 4,754,928 | 7/1988 | Rogers et al. . | |

FOREIGN PATENT DOCUMENTS

| | | | |
|---|---|---|---|
| 758478 | 5/1967 | Canada | 239/460 |

*Primary Examiner*—Andres Kashnikow
*Assistant Examiner*—William Grant
*Attorney, Agent, or Firm*—Kinzer, Plyer, Dorn, McEachran & Jambor

[57] ABSTRACT

A shower head has a shell which is brass with a plated or painted finish. There is an exterior polyurethane coating to prevent corrosion. The interior of the shower head includes a water flow control with a spray former at one end thereof. A plastic sleeve is positioned against the inside of the shell and extends to and cooperates with the spray former to form a spray discharge pattern for the shower head. The plastic sleeve is required to avoid any adverse effect from the protective polyurethane coating or from a paint finish on the function of the spray former discharge openings.

8 Claims, 1 Drawing Sheet

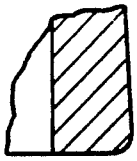
Fig.1.
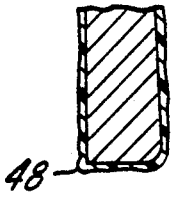
Fig.2.
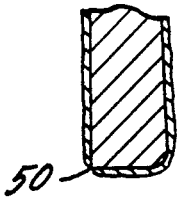
Fig.3.
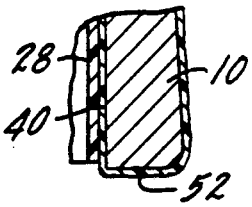
Fig.4.
Fig.5.
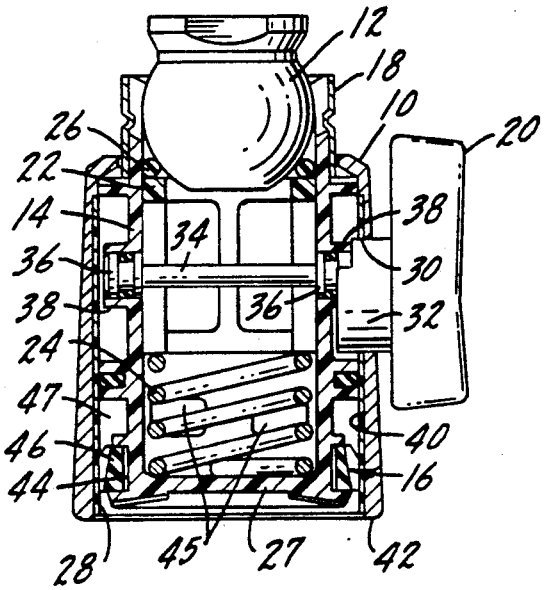
Fig.7.
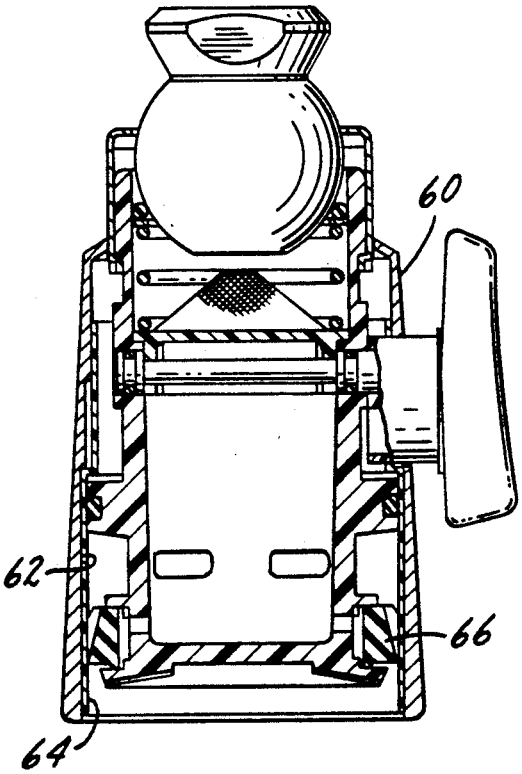
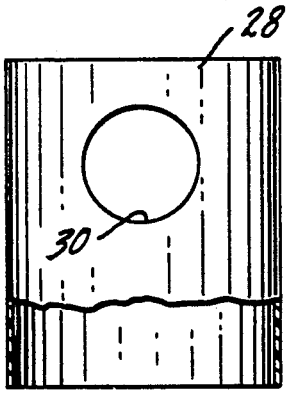
Fig.6.
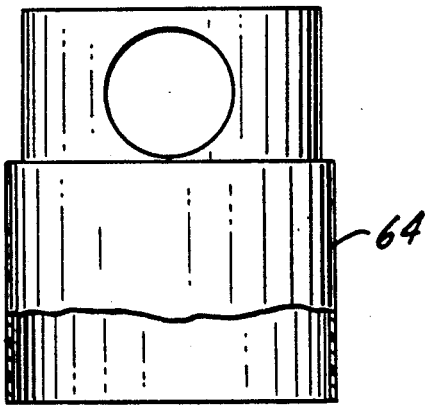
Fig.8.

SHOWER HEAD WITH INTERIOR PLASTIC SLEEVE

THE FIELD OF THE INVENTION

The present invention relates to shower heads and particularly to shower heads having an interior spray former with a plurality of exterior peripheral grooves which provide the spray discharge openings for the shower head. A protective coating such as polyurethane which is applied over the shower head finish may tend to accumulate at the interior corner of the shell which has an adverse effect on the spray pattern. The present invention provides an interior plastic sleeve which cooperates with the spray former grooves, eliminating any negative effect from the accumulation of the exterior protective coating.

DESCRIPTION OF THE RELATED ART

Shower heads of the type shown in U.S. Pat. No. 3,997,116 owned by Moen Incorporated, assignee of the present application, use a spray former which cooperates with the inside of a shell to form the spray discharge pattern. A similar shower head is shown in U.S. Pat. No. 4,275,843, also owned by Moen Incorporated.

SUMMARY OF THE INVENTION

The present invention relates to shower heads and particularly to shower heads having a shell finish which requires a painted or spray-on protective coating.

A primary purpose of the invention is a shower head as described including an interior plastic sleeve which prevents a painted or spray-on protective coating from inhibiting the function of the spray former in the shower head.

Other purposes will appear in the ensuing specification, drawings and claims.

BRIEF DESCRIPTION OF THE DRAWINGS

The invention is illustrated diagrammatically in the following drawing wherein:

FIG. 1 is a partial section of the shower head shell illustrating acceptable design conditions in which there is a sharp corner at the interior of the shower head shell, FIG. 2 is a similar section illustrating the accumulation of protective coating when a metal part is polish brass-plated and protective coated, FIG. 3 is a similar section illustrating the corner of the metal part when paint only is applied thereto, FIG. 4 is a similar section showing the position of the protective coating when the metal part has an interior plastic sleeve, FIG. 5 is an axial section through one form of shower head illustrating the use of the plastic sleeve of FIG. 4, FIG. 6 is a side view, in part section, of the plastic sleeve used in the shower head of FIG. 5, FIG. 7 is an axial section through another form of shower head illustrating the use of a plastic sleeve as described, and FIG. 8 is a side view, in part section, of the plastic sleeve used in FIG. 7.

DESCRIPTION OF THE PREFERRED EMBODIMENT

Moen Incorporated, the assignee of the present application, has for some years manufactured and sold a line of shower heads in which there is an interior movable spray former which cooperates with the inside surface of the shell to form a spray discharge pattern. It is essential in such a unit that the inside corner of the shell be sharply defined to obtain a proper discharge spray pattern. To date, such shower heads have had a chrome-plated exterior and chrome plating can be precisely controlled so that there is little accumulation of the plating material on the inside corner of the shell. What accumulation there is has no negative effect on the spray pattern formed by the interior spray former. A polished or antique brass plating tends to provide more accumulation of plating material at the corner. Further, brass plating requires a protective coating such as a polyurethane. When this coating is sprayed on, it accumulates at this inside corner, exaggerating the effect of the accumulated brass plating material. This accumulation eliminates the required sharply defined corner and has an adverse effect on the spray pattern. A similar problem arises with shower heads having a colored exterior painted finish. In this case, there is an absence of paint at the corner which permits corrosion to start and migrate. Also, paint on the inside surface is not satisfactory for a good spray pattern.

The present invention avoids these problems by providing a plastic sleeve for the interior of the shower head shell, with the sleeve cooperating with the spray former to form a precisely defined spray pattern. Any accumulation of the protective coating on the brass plated or painted shell has no effect on the spray pattern because of the interior plastic sleeve.

FIG. 5 illustrates a type of shower head which is presently manufactured by Moen Incorporated and conventionally has an exterior chrome plated finish on the shell. The shell is indicated at 10 and there is a ball 12 which is used to attach the shower head to a pipe or conduit. Inside of the shell 10 is a shower head body 14 which mounts a spray former 16 at one end thereof. The body 14 extends about a portion of ball 12 and is fastened thereto by a retainer 18. The shell 10 is positioned over the exterior of the body and there is an exterior handle 20 for use in changing the spray pattern. Rotation of handle 20 has the effect of axially moving shell 10 to change the relationship between the interior of the shell and spray former 16. A seat 22 is positioned between a coil spring 24 and a seal ring 26. The spring biases the seat against the seal ring, with the spring being bottomed on the closed end 27 of the body 14. The spring, seat and seal all cooperate to maintain the shower head in position on ball 12.

On the inside of shell 10 is a plastic sleeve 28 which has an opening 30 to accommodate an eccentric 32 of the handle assembly 20. The handle assembly includes a shaft 34 which has ends 36 mounted in bosses 38 on the body 14. Thus, when the handle is turned, the shell will move relative to the body, as determined by the interaction of eccentric 32 and sleeve opening 30.

The plastic sleeve fits within a recess 40 on the inside of shell 10. The sleeve extends substantially the entire length of the shell and terminates generally adjacent the discharge end 42 of the shell.

Spray former 16, which is made of a flexible material, fits within a groove 44 on the exterior of body 14 and has a plurality of exterior grooves 46, with portions intermediate the groove being in contact with the inside surface of sleeve 28. Thus, the actual spray pattern is defined by the grooves 46 and the relative position of these grooves and the discharge end 42 of shell 10. This is described in more detail in the above-referenced U.S.

patents. Incoming water flows through ball 12 to the interior of body 14, then outwardly through openings 45 to the exterior chamber 47 above the spray former.

In order to form a precise spray pattern at the discharge end of the shower head, the spray forming grooves 46 must cooperate with a relatively sharp corner at the discharge end of the shell. FIG. 1 illustrates the desired sharpness of the corner.

Heretofore the shower head shell has been chrome plated and it is possible to accurately control the thickness and area of deposit of the plating such that there is little accumulation of the plating material on the inside of the shower head shell. However, when brass is the plating material, there is substantially more accumulation of the plating material at the corner. Further, it is necessary to put a protective coating on top of the brass plating to prevent corrosion. This is true whether the brass plating be a polished brass or antique brass finish. In either event, a polyurethane coating is required. FIG. 2 illustrates the combined accumulation 48 of the plating material and protective coating at the inside corner of the shell which results from spraying a polyurethane coating on a polished brass plated shell. Such an accumulation will destroy the spray pattern from the spray former and provides an unacceptable product.

When the shower head has a paint finish, there can be an absence of the finish at the corner. The protective coating, if used, may also be thin or non-existent at this location. FIG. 3 illustrates the result which is insufficient coating at the corner, as indicated at 50, providing an area for corrosion which, once started, tends to migrate throughout the product.

FIG. 4 illustrates the utility of the plastic sleeve 28 of FIG. 5. Note that the sleeve terminates generally adjacent the end of shell 10 and that the protective coating 52 is isolated by the sleeve, where it would have any adverse effect on the pattern formed by the spray former.

FIG. 7 illustrates a further embodiment of shower head, which is particularly like that shown in U.S. Pat. No. 3,997,116. The interior parts are described in more detail therein. In this instance, the shell 60 has an interior surface 62 which has cylindrical portions of differing diameter joined by an intermediate shoulder. A plastic sleeve 64 having the identical configuration of surface 62 is positioned therein and is a close fit with the interior of shell 60 throughout a substantial portion of its length. The plastic sleeve terminates generally at the discharge end of the shell. The sleeve 64, which is illustrated in detail in FIG. 8, functions in the same manner as the sleeve 28 of FIG. 6. The sleeve cooperates with the spray former 66 in forming a satisfactory spray discharge pattern and eliminates any adverse effect brought about by the use of a spray protective coating or paint on the interior of the shell.

Whereas the preferred form of the invention has been shown and described herein, it should be realized that there may be many modifications, substitutions and alterations thereto.

The embodiments of the invention in which an exclusive property or privilege is claimed are defined as follows:

1. A shower head including a metal shell having a non-metallic exterior protective coating thereon, said shell having a discharge end, water inlet means, water flow control means attached to said inlet means, a non-metallic sleeve positioned against the inside of said shell and extending substantially the full length thereof and terminating substantially at the discharge end of said shell, said non-metallic exterior protective coating extending about the discharge end of said shell and extending in part between said shell and said non-metallic sleeve at the discharge end of the shell and sleeve, said water flow control means includng a spray former positioned adjacent the discharge end of said shell, said spray former having exterior grooves and exterior portions, intermediate the grooves, in contact with the interior of said non-metallic sleeve, said spray former grooves forming passages for the spray discharge of water from said shower head.

2. The shower head of claim 1 further characterized in that said shell is formed of brass and the non-metallic exterior protective coating is a polyurethane.

3. The shower head of claim 2 further characterized in that said sleeve is formed of plastic.

4. The shower head of claim 1 further characterized in that said sleeve is cylindrical.

5. The shower head of claim 1 further characterized in that said sleeve is cylindrical and has portions of differing diameter.

6. The shower head of claim 1 further characterized in that said metal shell has a recess on the interior thereof, said sleeve being positioned in said recess.

7. The shower head of claim 1 further characterized in that said shell has a painted finish, said protective coating being on top of said painted finish.

8. The shower head of claim 1 further characterized in that the exterior of said shell has a brass plating, said protective coating being applied over said brass plating.

* * * * *